US005692731A

United States Patent [19]

Beauchamp

[11] Patent Number: 5,692,731

[45] Date of Patent: Dec. 2, 1997

[54] SAFETY DEVICE FOR HYDRAULIC ENGINE HOIST

[76] Inventor: Philipe Joseph Beauchamp, P.O. Box 245, Kurtistown, Hi. 96760-0245

[21] Appl. No.: 601,071

[22] Filed: Feb. 12, 1996

[51] Int. Cl.[6] ..... B66F 3/30

[52] U.S. Cl. ..... 254/124; 254/8 R; 254/8 B

[58] Field of Search ..... 254/124, 8 B–8 R, 254/120, 129, 130, 2 B

[56] References Cited

U.S. PATENT DOCUMENTS

| | | | |
|---|---|---|---|
| 3,602,338 | 8/1971 | Sherry | 187/206 |
| 3,833,091 | 9/1974 | MacPherson | 187/206 |
| 3,931,956 | 1/1976 | Hawkins | 254/8 B |
| 4,023,649 | 5/1977 | Wood | 187/206 |
| 4,088,303 | 5/1978 | Aquila | 254/124 |
| 4,231,550 | 11/1980 | Castoe | 254/124 |
| 5,040,637 | 8/1991 | Hawk | 187/206 |
| 5,339,927 | 8/1994 | Truax | 187/206 |
| 5,547,001 | 8/1996 | Cumming et al. | 254/130 |

*Primary Examiner*—Timothy V. Eley
*Assistant Examiner*—Lee Wilson
*Attorney, Agent, or Firm*—Patent & Trademark Services, Inc.; Joseph H. McGlynn

[57] ABSTRACT

A conventional hydraulic engine hoist equipped with a pair of support arms attached to the frame members of the hoist. One of the support arms is fixedly attached to a vertical frame member and the other support arm is attached to a horizontal fame member. The first support arm has a series of pins mounted thereon, and the second support arm has a forked end which cooperates with the pins to prevent the horizontal frame member from moving downward.

2 Claims, 1 Drawing Sheet

SAFETY DEVICE FOR HYDRAULIC ENGINE HOIST

BACKGROUND OF THE INVENTION

This invention relates, in general, to safety devices, and, in particular, to safety devices for hydraulic engine hoists.

DESCRIPTION OF THE PRIOR ART

In the prior art various types of safety devices for hoists have been proposed. For example, U.S. Pat. No. 3,602,338 discloses an elongated lever located inside of a nonrotatable tube that has a detent pin projecting through an aperture in the tube. Lowering of the nonrotatable tube is prevented by the detent pin. U.S. Pat. No. 3,833,091 discloses a rod mounted to move with the piston of a lift, and the rod is reciprocal in the bore of a collar which has two balls that ride in diametrically opposite grooves. The balls ride on diametrically arcuate cylindrical surfaces to lock the rod in any elevated position. U.S. Pat. No. 4,023,649 discloses a safety lock for a lift having a pair of inner and outer members. The lock device is a friction brake that locks the inner member against movement. U.S. Pat. No. 5,339,927 discloses an auxiliary safety support mechanism having permanent magnets arranged at spaced points along its length. The post can be manually inserted under the hoist platform to keep it from coming down, and the magnets mount the post for storage.

All of the prior art devices suffer from short comings. For example the U.S. Pat. No. 5,339,927 device must be inserted manually beneath the hoist. If the user forgets to install the safety device, there will be no security for the operator in case of an accident. The other prior art devices must be incorporated into the lifts during manufacture and can not be retrofitted to the hoists.

The present invention solves the deficiencies of the prior art devices by providing a safety device that can be retrofitted to any engine hoist. Also, it works automatically as the hoist is in use and therefore the operator can not forget to engage the safety device.

SUMMARY OF THE INVENTION

The present invention consists of a conventional hydraulic engine hoist equipped with a pair of support arms attached to the frame members of the hoist. One of the support arms is fixedly attached to a vertical frame member and the other support arm is attached to a horizontal frame member. The first support arm has a series of pins mounted thereon, and the second support arm has a forked end which cooperates with the pins to prevent the horizontal frame member from moving downward.

It is an object of the present invention to provide a safety device for a hydraulic engine hoist which can be retrofitted to any engine hoist.

It is an object of the present invention to provide a safety device for a hydraulic engine hoist which is inexpensive to manufacture.

It is an object of the present invention to provide a safety device for a hydraulic engine hoist which will work automatically to prevent the hoist from slipping while an engine is attached.

These and other objects and advantages of the present invention will be fully apparent from the following description, when taken in connection with the annexed drawings.

DESCRIPTION OF THE PREFERRED EMBODIMENT

Figure 1:
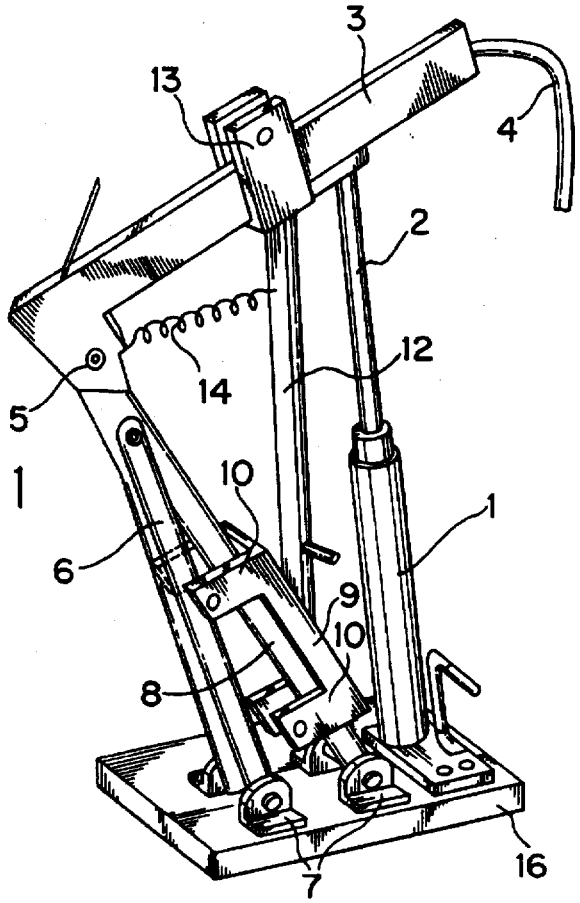
FIG. 1 is a perspective view of the present invention attached to a conventional hydraulic engine hoist.

Referring now to the drawings in greater detail, FIG. 1 shows a conventional hydraulic engine hoist comprising a horizontal support member 3, and vertical support members 6 and 8. The vertical members are secured to a base 16 by brackets 7. Also attached to base 16 is a hydraulic cylinder 1,2 which will lift horizontal support member 3 with respect to the vertical support members by hydraulic pressure. The horizontal support member 3 is pivoted to the vertical member 8 by a pivot pin 5. The hydraulic engine hoist works in a conventional manner. As the inner rod 2 is raised by hydraulic pressure with respect to the outer cylinder 1 the horizontal member 3 will be lifted up. Anything, such as an automobile engine, attached to the attachment means 4 (only partially shown) will be raised as member 3 is raised.

Figure 2:
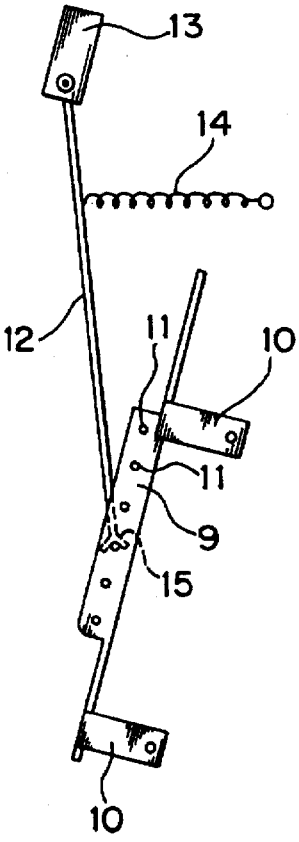
FIG. 2 is a side view of the present invention.
Figure 3:
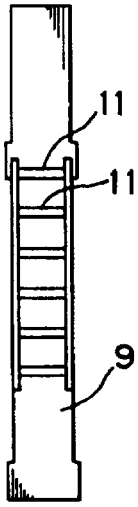
FIG. 3 is a internal view of the present invention.
Figure 4:
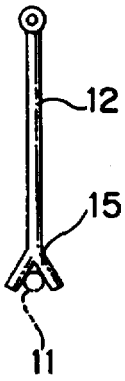
FIG. 4 is side view of one of the safety members of the present invention.

Essentially the only thing preventing the horizontal member 3 from falling is the hydraulic cylinder 1, 2. If the cylinder slips while a heavy object such as an automobile engine is being lifted, the user is subject to serious injury. In order to avoid this, a safety device is attached to the horizontal member 3 and the vertical member 8. A first support member 9 is attached to vertical member 8 by brackets 10 and bolts or by any other conventional means. Support member 9 has a plurality of support pins or rods 11, (see FIGS. 2 and 3) spaced along its length.

A second support member 12 is pivotally attached to the horizontal member 3 at 13. The opposite end of member 12 has a forked end 15 which is large enough to receive the pins 11. Also, a tension spring 14 is attached to the upper end of member 12 and to pivot pin 5 where the horizontal member 3 and vertical member 8 are joined. The spring will tension the arm 12 toward the vertical member 8 and the support member 8 at all times.

In use, as the hydraulic cylinder 1, 2 raises horizontal member 3, the forked end 15 of support member 12 will ride up and over each pin 11 until the cylinder is at its highest point. At this point the forked end 15 will rest on top of one of the pins 11. If the hydraulic cylinder slips, the support member 12 with its forked end attached to one of the pins 11 will prevent the horizontal member 3 from moving downward. This will prevent the engine (not shown), attached element 4 from falling and possibly injuring the operator.

When it is necessary to lower the engine, support member 12 is moved away from support member 9 by pulling on handle 16. This will disengage the forked end 15 of support member 12 from the pins 11 on support member 9 and the hoist can then be lowered.

Although the safety device for a hydraulic engine hoist and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A safety device for a hydraulic engine hoist, wherein said hoist has a horizontal support arm with an attachment means on one end for attaching an engine, and at least one vertical support arm, and a hydraulic means for moving said horizontal support arm with respect to said at least one vertical support arm, said safety device comprising:

a first member attached to said at least one vertical support arm, said first member having a plurality of pins spaced there along, a second support member pivotally attached at one end to said horizontal support arm, said second support member having means for engaging said plurality of pins at another end, and spring means for holding said second support member in engagement with said plurality of pins.

2. A safety device for a hydraulic engine hoist, wherein said hoist has a horizontal support arm with an attachment means on one end for attaching an engine, and at least one vertical support arm, and a hydraulic means for moving said horizontal support arm with respect to said at least one vertical support arm, said safety device comprising:

a first member attached to said at least one vertical support arm, said first member having a plurality of pins spaced there along, a second support member pivotally attached at one end to said horizontal support arm, said second support member having means for engaging said plurality of pins at another end, and spring means for holding said second support member in engagement with said plurality of pins, and wherein said means for engaging said plurality of pins is a forked end on said second support member.

* * * * *